US009957583B2

(12) United States Patent
Zhang et al.

(10) Patent No.: US 9,957,583 B2
(45) Date of Patent: May 1, 2018

(54) METHOD FOR REPAIRING BREAK OF UNIVERSAL CONNECTING ROD OF UNIVERSAL COUPLING

(71) Applicant: Wuhan Kaiming High Tech Co., Ltd., Wuhan, Hubei (CN)

(72) Inventors: Kaiming Zhang, Hubei (CN); Weiguo Wu, Hubei (CN); Jianhua Fan, Hubei (CN); Sigu Zhu, Hubei (CN); Guanglei Chen, Hubei (CN); Wenhe Chen, Hubei (CN); Li Lin, Hubei (CN); Tingxi Xiao, Hubei (CN); Wei Li, Hubei (CN); Fuquan Liu, Hubei (CN); Jiang Li, Hubei (CN); Fei Wang, Hubei (CN); Wenbin Luo, Hubei (CN); Xiaoping Li, Hubei (CN)

(73) Assignee: Wuhan Kaiming High Tech Co., Ltd., Wuhan, Hubei Province (CN)

( * ) Notice: Subject to any disclaimer, the term of this patent is extended or adjusted under 35 U.S.C. 154(b) by 332 days.

(21) Appl. No.: 14/843,510

(22) Filed: Sep. 2, 2015

(65) Prior Publication Data

US 2015/0368733 A1 Dec. 24, 2015

(30) Foreign Application Priority Data

Jan. 23, 2015 (CN) ..... 2015 1 0035066

(51) Int. Cl.

| | |
|---|---|
| ***C21D 9/00*** | (2006.01) |
| ***C22C 30/00*** | (2006.01) |
| ***C21D 1/84*** | (2006.01) |
| ***C21D 1/55*** | (2006.01) |
| ***C21D 1/26*** | (2006.01) |
| ***C22C 38/08*** | (2006.01) |
| ***C22C 38/44*** | (2006.01) |
| ***C22C 38/04*** | (2006.01) |
| ***C22C 38/02*** | (2006.01) |
| ***C22C 38/00*** | (2006.01) |
| ***C21D 9/28*** | (2006.01) |
| ***C21D 9/50*** | (2006.01) |

(52) U.S. Cl.

CPC ..... *C21D 9/0075* (2013.01); *C21D 1/26* (2013.01); *C21D 1/55* (2013.01); *C21D 1/84* (2013.01); *C21D 9/28* (2013.01); *C21D 9/505* (2013.01); *C22C 30/00* (2013.01); *C22C 38/002* (2013.01); *C22C 38/02* (2013.01); *C22C 38/04* (2013.01); *C22C 38/08* (2013.01); *C22C 38/44* (2013.01)

(58) Field of Classification Search

CPC ..... C21D 9/0075; C21D 1/84; C21D 1/55; C21D 1/26; C21D 9/28; C21D 9/505; C22C 30/00; C22C 38/08; C22C 38/44; C22C 38/02; C22C 38/002; C22C 38/04

See application file for complete search history.

*Primary Examiner* — Jessee Roe

(57) ABSTRACT

A method for repairing break of a universal connecting rod of a universal coupling includes steps of: cleaning and detecting cracks, providing primary anneal, depositing alloys, providing secondary anneal, manually milling and controlling a quality; wherein depositing the alloys includes forming gradient in an order of a bonding layer, a transition layer, a working layer and a processing layer; wherein the bonding layer: S and P in the depositing area are diluted with an FGM-KM1# material, for removing or reducing the S and P, so as to avoid cold and hot cracks; the transition layer: which is formed by an FGM-KM2# material for improving impact toughness and evacuation stress, and appropriate increasing hardness; the working layer: which is formed by an FGM-KM3# material for improving heat resistance, wear resistance and load capacity; and the processing layer: an FGM-KM4# material is used to reduce surface hardness and improve processing performance.

6 Claims, 2 Drawing Sheets

METHOD FOR REPAIRING BREAK OF UNIVERSAL CONNECTING ROD OF UNIVERSAL COUPLING

CROSS REFERENCE OF RELATED APPLICATION

The present invention claims priority under 35 U.S.C. 119(a-d) to CN 201510035066.9, filed Jan. 23, 2015.

BACKGROUND OF THE PRESENT INVENTION

Field of Invention

The present invention relates to a field of universal coupling, and more particularly to a method for repairing break of a universal connecting rod of a universal coupling.

Description of Related Arts

At present, universal connecting nods of heavy load and over load linear universal couplings widely used in main driving devices of heavy machines such as hot tandem cogging mills, large merchant steel rolling mills, punch machines, as well as middle-width thick plate and Steckle mills are easy to be damaged: on the one hand, heavy load and over load universal couplings used in the above heavy machines are huge, rotary diameter thereof is 650 mm to 1300 mm, torque thereof is 2300 kn·m to 19405 kn·m, resulting in huge impact load at moments of starting or emergency power off, i.e. impact load with large instant torque; on the other hand, during working, the universal connecting nods will be affected by a force of a high frequency alternating impact load.

In summary, reason of the above break is: fatigue break at a root of an axle neck is a main failure mode of the universal connecting rod. Technical difficulties during solving a strength problem of the component are as follows: firstly, equipment space is a restricting factor, which means a load capacity of the heavy load and over load linear universal couplings cannot be improved by increasing a size of the universal connecting rod; secondly, the device has a problem of stress concentration during working, which will result in the fatigue break at the root of the axle neck of the universal connecting rod; finally, the conventional universal connecting rod is mainly formed by billet steel hot forging, then the axle neck thereof is processed with a CNC (computerized numerical control) machine. However, a transition structure of the root of the axle neck of the universal connecting rod is usually single circular arc surface smooth transition or step type transition. The universal connecting rod with single circular arc surface smooth transition is restricted by a size of a linear axle structure because of a transition arc size is too large, which cannot overcome the problem of stress concentration problem. Stress concentration still exists at the root of the axle neck of the universal connecting rod with such transition, so break is still easy to happen. In addition, machining of such structure is difficult, and manufacturability thereof is poor, which lowers production efficiency. Therefore, a step type transition fillet structure is mainly used. Stress concentration exists wherein sudden change of cross sections of the universal connecting rod happens, that is to say, under heavy load and torque is more than 2800 kn·m, break is extremely easy to happen, which cannot be effectively solved at present.

As a result, an axle end and an axle body of the universal connecting rod, a key component of the heavy load and over load universal coupling are easy to break, resulting in out of service. Metal materials, strength, temperature, technology, process and heat deformation of common welding crack repairing are difficult to control, resulting in that a welding temperature of a welding bead is too high, which causes heat deformation. In addition, because of improper welding techniques, welding stress resides at a welding part is too large and strength is not even, which generates new cracks, and intensifies heat stress deformation. Therefore, new deformation is inevitable, which will lead to unusable and directly affects normal production. That is a major problem that enterprises urgently need to solve.

Development of a repairing technique without heat stress deformation is a subject of universal shaft coupling repairing.

European patent EP1930116 A2 discloses a crack repairing method, which directly deposits a nano alloy 28 in the crack, then deposits a filler alloy 30 on the nano alloy 28. Preferably, the above alloys are nickel or cobalt base superalloy for steam turbine fittings. The above method cannot repair a potential crack.

U.S. patent US2005015980A1 discloses a method for repairing cracks of a steam turbine part, which drills a repairing groove 18 at a crack 16. A depth of the repairing groove 18 cannot be extended to a cavity 14 beneath, and the repairing groove 18 is drilled by manual grinding, machining or electrical discharge machining. A filler 20 is deposited in the repairing groove 18 by a. The micro plasma welding machine with low ampere inputs heat to the repairing groove 18 of the input heat, so as to form a thin heat impact layer 22 at a surface of the repairing groove 18 of the steam turbine part. The heat impact layer reduces strength of the steam turbine part repaired.

SUMMARY OF THE PRESENT INVENTION

For solving problems in conventional technologies, the present invention provides a method for repairing a joint break of an axle end and an axle body of a universal coupling, which is easy to operate, rapid for emergency, high in repairing quality, without deformation and low in cost.

The present invention has advantages as follows:

1: metallurgical bonding force is greater than or equal to 500 N, and is consistent with a base material bonding strength, so as to meet technical requirements of no deformation, no trenching, and no flaking; FGM-KM materials have sufficient self-fluxing and liquidity after combined with a base.

2: a recovery thickness is above 1-1000 mm.

3: wear resistance, impact resistance, thermal fatigue resistance, anti friction, anti wear, anti erosion wear, and anti particle wear are sufficient, impact toughness of the present invention are higher than those of a new component, a service life thereof is 1-5 times of the one of the new component, a price thereof is only 5%-25% of the one of the new component.

4: a "rapid repair" technical standards of dispersion strengthened composite gradient functional materials (FGM-KM) are developed, see copyright: 2011-A-038708.

Accordingly, in order to accomplish the above object, the present invention provides a method for repairing break of a universal connecting rod of a universal coupling, comprising steps of:

1) cleaning and detecting cracks, for identifying damage degrees of different parts of the universal connecting rod of the universal coupling; wherein the step 1) specifically comprises steps of:

a: cleaning surface greasy dirt, a rust layer, a fatigue layer and irregular cracks, combining colored crack detection and ultrasound crack detection for ensuring base cracks are completely detected and an accurate detection result is obtained; wherein no potential defects are neglected;

b: if the cracks exist at a joint of an axle end of the universal connecting rod and a body axle, where a shear stress is most concentrated, eliminating by turning; specifically, defining the crack as a center line, turning a U-shaped groove which is evenly distributed at both sides of the center line with a turning tool; turning at two faces of the universal connecting rod in such a manner that an upper portion and an lower portion of the groove form a shape of ⋈; adding cooling liquid during turning for cooling, so as to strictly control an axle temperature at 40-50° C., which is cool enough to handle;

c: combining the colored crack detection and the ultrasound crack detection for detecting, so as to ensure that base defects are completely eliminated;

d: coarsening: cleaning a greasy dirt layer, turning the fatigue layer for 5-10 mm, then identifying whether a crack defect exists or not by the ultrasound crack detection; and e: purifying: removing fragments and residues on metal surfaces of a component to be repaired with NaOH, $Na_2CO_3$ and $NaNO_3$;

2) providing primary anneal: sampling for detecting a chemical element ingredient of a base, and identifying proportions of different chemical elements in the base; calculating a coefficient of expansion, and setting overall temperature increase and decrease time and speed of the universal coupling, putting into an ion radiation furnace, and providing gradient heating;

3) forming gradient in an order of a bonding layer, a transition layer, a working layer and a processing layer, preparing depositing alloys with an immerse-melting method; depositing layer by layer with a high-power welding machine and a special welding stick, in such a manner that 43% of the depositing alloys infiltrate into 57% of a base metal according to a depositing layer requirement until a certain redundancy is reached;

4) providing secondary anneal: after a depositing layer reaches the certain redundancy, putting into the ion radiation furnace again; according to a design requirement, controlling a temperature during a whole process, keeping the temperature and then providing gradient cooling as well as eliminating a welding stress, for avoiding too much contrast of an overall temperature of the base which forms a new stress construction point and thus generates new potential break; after reaching a design temperature, taking out of the ion radiation furnace and cooling to a room temperature;

5) firstly milling a peak of the depositing layer with a manual milling method, then machining and mechanically milling a repaired portion, so as to ensure that a repaired surface satisfies size and performance requirements of a blueprint; and 6) controlling a quality: through appearance analysis and comparison, size detection, hardness comparison before and after repairing, chemical element detection of a depositing area and the base, the ultrasound crack detection, and magnetic powder crack detection, ensuring the quality of overall repairing.

Preferably, temperatures of the gradient heating of the primary anneal are 30° C., 50° C., 100° C., 150° C., 200° C., 250° C., 300° C., 350° C., 400° C., and 480° C. in sequence, a period for each temperature is 0.5-1.5 h.

Preferably, temperatures of the gradient cooling of the secondary anneal are 280° C., 250° C., 200° C., 150° C., 100° C., 50° C. and 30° C. in sequence, a period for each temperature is 0.5-1.5 h.

Preferably, at the bonding layer, S and P in the depositing area are diluted with an FGM-KM1# material, for removing or reducing the S and P, so as to avoid cold and hot cracks; the FGM-KM1# material comprises Ni 0.70-0.80%, C 0.066-0.070%, Mn 0.4-0.42%, WC 0.14-0.16%, and S 0.010-0.22%.

Preferably, the transition layer is a coating layer with a gradient feature according to a depth requirement of a work piece break point, whose depositing depth is above 1-1000 mm, for transiting, gradually hardening and size recovering; the transition layer is formed by an FGM-KM2# material for improving impact toughness and evacuation stress, and appropriate increasing hardness; the FGM-KM2# material comprises C≤10%, Mn 1.30-1.40%, Si≤0.48%, Mo 0.28-0.40%, Ni 1.50%, Cr≤0.60%, S≤0.020%, and P≤0.018%.

Preferably, the working layer mainly satisfies depositing layer hardness, which is mainly based on requirements of working conditions and technical requirements such as wear resistance, corrosion resistance, temperature resistance, and impact toughness; corresponding alloy elements used completely satisfy a Rockwell hardness requirement of HRC 30°-38°; the working layer is formed by an FGM-KM3# material for improving heat resistance, wear resistance and load capacity; the FGM-KM3# material comprises C 0.3%, G 8%, B 2%, Si 2.5%, Fe 5%, Ni≤50%, and We 35%.

Preferably, the processing layer is a ferrite soft layer, which is conducive to machining and improving manufacturing speed; the processing layer is entered easily and rapidly; and after fine processing, a technical requirement of a hard-surface alloy layer is satisfied;

wherein the processing layer is formed by an FGM-KM4# material, comprising C 0.07%, Fe 0.32%, Mn 0.30%, Si 0.16%, S 0.01%, and P 0.010%.

The present invention has technical effects as follows. According to the present invention, a universal connection rod is 11 m long with a diameter of 860 mm, whose crack is completely broken. A ⋈ groove size is 860 mm, wherein one face is 430 mm, two faces are totally 860 mm, for completely repairing. Torque of the repair portion is up to 2800 kn·m-3800 kn·m, and a bonding force thereof is equal to or larger than 500 N. A metallographic phase microstructure has a high density without depositing defects. According to the ultrasonic crack detection, a requirement of grade II in standard GB11345 is satisfied, wherein a crystal structure is excellent, and welding quality is sufficient.

These and other objectives, features, and advantages of the present invention will become apparent from the following detailed description, the accompanying drawings, and the appended claims.

DETAILED DESCRIPTION OF THE PREFERRED EMBODIMENT

Figure 1:
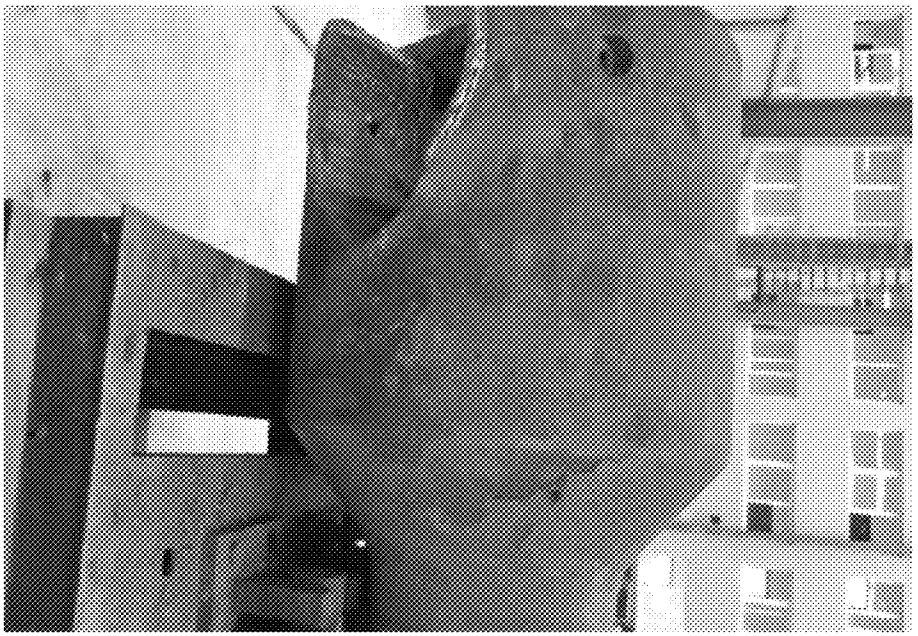
FIG. 1 is a sketch view of a damaged degree of a universal connection rod of a coupling from a bar factory of Hunan Valin Xiangtan Iron and Steel Co., Ltd.
Figure 2:
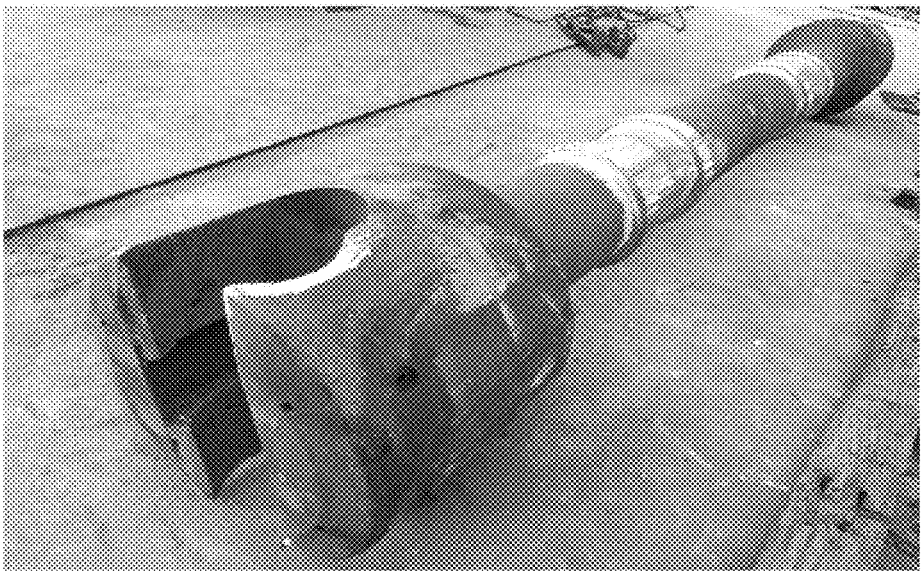
FIG. 2 is a sketch view of a purified universal connection rod of the coupling from a bar factory of Hunan Valin Xiangtan Iron and Steel Co., Ltd.
Figure 3:
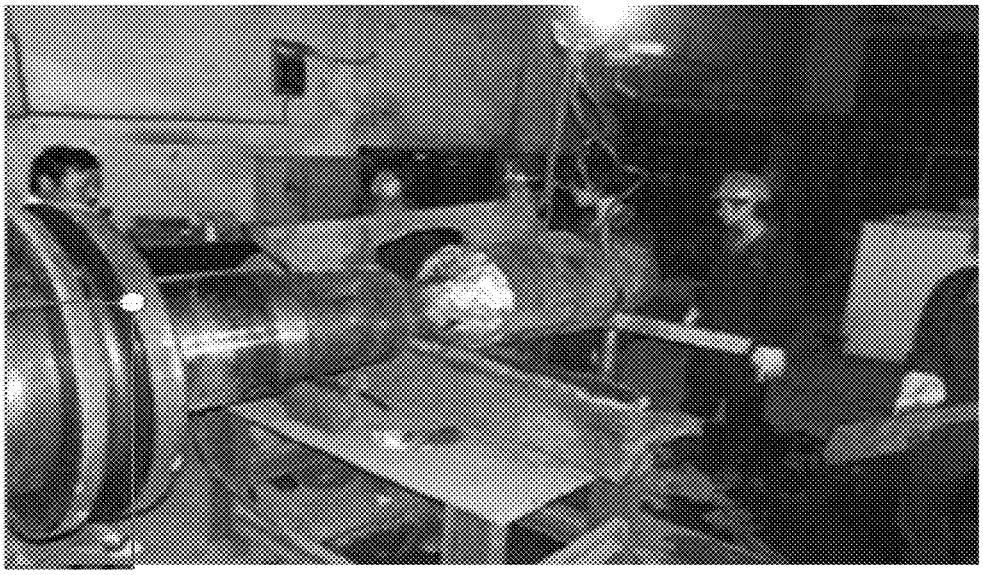
FIG. 3 is a sketch view of a damaged degree of a universal connection rod of a Russian 16000T main axle coupling from Dongfeng Forging Co., Ltd.
Figure 4:
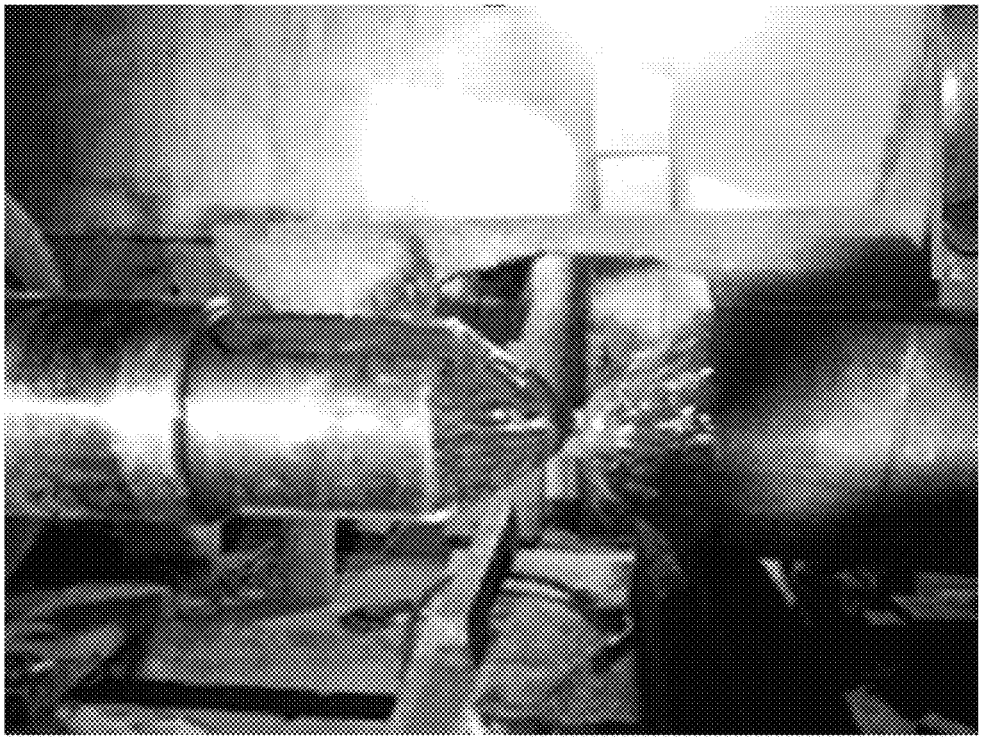
FIG. 4 is a sketch view of a purified universal connection rod of the Russian 16000T main axle coupling from Dongfeng Forging Co., Ltd.

The present invention as shown in the following preferred embodiment is exemplary only and not intended to be limiting.

Preferred Embodiment 1) cleaning and detecting cracks, for identifying damage degrees of different parts of the universal connecting rod of the universal coupling.

a: cleaning surface greasy dirt, a rust layer, a fatigue layer and irregular cracks, providing ultrasound crack detection for deep cracks and colored crack detection for shallow cracks; combining the colored crack detection and the ultrasound crack detection for ensuring base cracks are completely cleaned.

b: if the cracks exist at a joint of an axle end of the universal connecting rod and a body axle, where a shear stress is most concentrated, eliminating by turning; specifically, defining the crack as a center line, turning a U-shaped groove which is evenly distributed at both sides of the center line with a turning tool; turning at two faces of the crack in such a manner that an upper portion and an lower portion of the groove form a shape of ⋈; wherein during turning, a cooling effect must be guaranteed, so as to strictly control an axle temperature at 40-50° C., which is cool enough to handle;

wherein oxygen cutting (3000-3400° C.) is forbidden, because a melting point of $Fe_2O_3$ generated is 4300° C.; carbon arc gas cutting (6000-8000° C.) is also forbidden, because a temperature thereof is too high, resulting in deformation and carbon spots at the groove which is difficult to melt; the above cutting methods increase difficulty of welding and bring negative factors of bed welding performance, and thus are forbidden.

c: combining the colored crack detection and the ultrasound crack detection for detecting, so as to ensure that base defects are completely eliminated.

d: coarsening: cleaning a greasy dirt layer; after detecting by the ultrasound crack detection and no defect is detected, turning the fatigue layer, generally for 5-10 mm, until a good-condition metal layer is exposed, so as to ensure depositing and welding strength, increase bonding force, and metallurgical bonding of the base and the depositing materials.

e: purifying: removing fragments and residues on metal surfaces of a component to be repaired with NaOH, $Na_2CO_3$ and $NaNO_3$.

2) providing primary anneal: sampling for detecting a chemical element ingredient of a base, and identifying proportions of different chemical elements in the base; calculating a coefficient of expansion, and setting overall temperature change time and speed of the universal coupling, putting into an ion radiation furnace, and providing gradient heating;

wherein temperatures of the gradient heating of the primary anneal are 30° C., 50° C., 100° C., 150° C., 200° C., 250° C., 300° C., 350° C., 400° C., and 480° C. in sequence, a period for each temperature is 0.5-1.5 h;

wherein anneal is cooling to lower than 200° C. in the furnace, then taking out of the furnace under a sealed condition, and cooling to a room temperature.

3) forming gradient in an order of a bonding layer, a transition layer, a working layer and a processing layer, preparing depositing alloys with an immerse-melting method; depositing layer by layer with a high-power welding machine and a special dispersion strengthened composite (FGM-KM) according to the gradient, in such a manner that about 43% of the depositing alloys infiltrate into about 57% of a base metal according to a layer requirement, until a size according to a machining requirement of a depositing layer is reached.

a: the bonding layer: S and P in the depositing area are diluted with an FGM-KM1# material, for removing or reducing the S and P, so as to avoid cold and hot cracks.

The FGM-KM materials are dispersion strengthened composite gradient functional materials, which transform a single-phase structure into composite material with a multi-phase structure, so as to form a new depositing alloy layer after being deposited on a base surface. A metallurgical structure thereof is a depositing layer comprising pearlite, martensite, austenite and dual-phase wear-resistant alloy. The depositing alloy changes form solid to liquid, so as to be a half liquid half solid form. During primary crystallize and secondary crystallize, metal on the base surface is oxidized, deoxidized, and floated after low melt point boron silicate slag is formed, which forms a protection layer for metallurgical bonding of a melted alloy and a solid base metal treated, wherein a base surface metal layer diffuses to a depositing metal layer and infiltrates with each other, for finally forms a metallurgical bonding layer.

The FGM-KM1# material comprises Ni, C, Mn, and WC, as illustrated in table 1.

TABLE 1

| Ni | C | Mn | WC | S |
|---|---|---|---|---|
| 0.70-0.80% | 0.066-0.070% | 0.4-0.42% | 0.14-0.16% | 0.010-0.22% |
| tensile strength 560 (MPa) | yield strength 370 (MPa) | extending rate 31 | AKV impact power 60 | |

For different textures, different alloys are used, in such a manner that affinity between the depositing materials and the base is guaranteed. By changing the metallurgical structure of an original texture, the cold and hot cracks are avoided. For recovering a size, gradient hardening is a basic groundwork.

b: the transition layer: which is formed by an FGM-KM2# material for improving impact toughness and evacuation stress, and appropriate increasing hardness.

Object: sufficiently fusing different ingredients for not only increasing hardness but also satisfying a requirement of improving impact toughness, so as to recover the size and gradually harden.

The FGM-KM2# material comprises C, Mn, Si, Mo, Ni, Cr, S, and P, as illustrated in table 2.

TABLE 2

| C | Mn | Si | Mo | Ni | Cr | S | P |
|---|---|---|---|---|---|---|---|
| ≤10% | 1.30-1.40% | ≤0.48% | 0.28-0.40% | 1.50% | ≤0.60% | ≤0.20% | ≤0.18% |

c: the working layer: which is formed by an FGM-KM3# material for improving heat resistance, wear resistance and impact resistance.

Object: ensuring that the metal has excellent mechanical properties, heat resistance, and fatigue resistance, for multi-phase modification.

The FGM-KM3# material comprises C, Cr, Mn, We and Mo, as illustrated in table 3.

TABLE 3

| C | G | B | Si | Fe | Ni | We | at most 50% |
|---|---|---|---|---|---|---|---|
| 0.3% | 8% | 2% | 2.5% | 5% | the rest | 35% | |

d: the processing layer: an object of the processing layer is to improve the mechanical properties of the repaired parts, which not only leaves an appropriate redundancy for mechanical processing, but also ensures accuracy and progress of machining, so as to improve efficiency of machining. An FGM-KM4# material is used to reduce surface hardness and improve processing performance.

The FGM-KM4# material comprises C, Fe, Mn, and Si, as illustrated in table 4.

TABLE 4

| C | Fe | Mn | Si | S | P |
|---|---|---|---|---|---|
| 0.07% | 0.32% | 0.30% | 0.16% | 0.01% | 0.010% |

4) providing secondary anneal: after a depositing layer reaches the certain redundancy, putting into the ion radiation furnace again; according to a design requirement, controlling a temperature during a whole process, keeping the temperature and then providing gradient cooling as well as eliminating a welding stress, for avoiding too much contrast of an overall temperature of the base which forms a new stress construction point and thus generates new potential break; after reaching a design temperature, taking out of the ion radiation furnace and cooling to a room temperature;

5) firstly milling a peak of the depositing layer with a manual milling method, then machining and mechanically milling a repaired portion, so as to ensure that a repaired surface satisfies size and performance requirements of a blueprint; and 6) controlling a quality: through appearance analysis and comparison, size detection, hardness comparison before and after repairing, chemical element detection of a depositing area and the base, the ultrasound crack detection, and magnetic powder crack detection, ensuring the quality of overall repairing.

The above method has been applied for repairing cracks in the following companies:

1: No. 2 rolling mill factory of Daye Special Steel Co., Ltd.

2: Dongfeng Forging Co., Ltd.

3: Hubei Shenli Forging Co., Ltd.

4: Russian made universal connecting rods and imported parts from steel rolling mill factory of Xinye Steel Co., Ltd.

5: 5 m thick board factory of Hunan Valin Xiangtan Iron and Steel Co., Ltd.

6: Plate rolling mill factory, cold rolling mill factory and large-scale factory of Wuhan Iron And Steel Co., Ltd.

The present invention has advantages and positive effects as follows.

Compared with conventional Chinese advanced technologies such as laser technology, ultrasonic technology and plasma technology, the method has advantages as follows.

a: laser, ultrasonic and plasma technologies are only able to treat 1-3 mm of the hard-surface coating, while the method according to the present invention is able to treat coating with a thickness above 1-1000 mm. Hardness thereof reaches and exceeds conventional technical requirements, and achieves a purpose of phase-changing modification. Chemical, physical, mechanical properties thereof are all able to change from a single-phase structure to a multi-phase structure, which greatly improves performances such as hardness, strength, toughness, wear resistance and heat resistance. Hardness of the depositing layer is able to reach a Rockwell hardness requirement of HRC 30°-38°.

b: a structure and hardness of the depositing layer is 15%-50% higher than the conventional technologies, and the wear resistance is improved by 1-5 times, which is especially suitable for old, large, thick and heavy work pieces.

c: according to a work piece material, thickness, size, and shape, free adjustment and temperature control are effectively provided. For example, sufficient control of depositing linear energy, speed, etc. is able to effectively avoid defects such as deformation, porosity, slag inclusion, incomplete penetration, shore, arc pit, and cracks during depositing. Through best synergistic effect, it is ensured that the metallurgical bonding of the base and the depositing materials, which will not explode and crack, and are integrated.

d: the method is able to rapidly and efficiently repair scrap parts with serious damage, crack, large thickness, and large area to be repaired, which is unmatched by the conventional technologies.

e: a construction equipment uses excellent depositing FGM-KM materials and advanced technologies, which are fast, flexible and economical with rapid and emergency effects, and are easy to operate. Therefore, repairing cost is greatly reduced. Meanwhile, a service life and technical requirements of the repaired part equals to that of a new part, and is able to improve and satisfies working conditions, which should be widely applied.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for repairing break of a universal connecting rod of a universal coupling, comprising steps of:

1) cleaning and detecting cracks, for identifying damage degrees of different parts of the universal connecting rod of the universal coupling; wherein the step 1) specifically comprises steps of:

a: cleaning surface greasy dirt, a rust layer, a fatigue layer and irregular cracks, combining colored crack detection and ultrasound crack detection for ensuring base cracks are completely detected and an accurate detection result is obtained; wherein no potential defects are neglected;

b: if the cracks exist at a joint of an axle end of the universal connecting rod and a body axle, where a shear stress is most concentrated, eliminating by turning;

specifically, defining the crack as a center line, turning a U-shaped groove which is evenly distributed at both sides of the center line with a turning tool; turning at two faces of the universal connecting rod in such a manner that an upper portion and an lower portion of the groove form a shape of H; adding cooling liquid during turning for cooling, so as to strictly control an axle temperature at 40-50° C.;

c: combining the colored crack detection and the ultrasound crack detection for detecting, so as to ensure that base defects are completely eliminated;

d: coarsening: cleaning a greasy dirt layer, turning the fatigue layer for 5-10 mm, then identifying whether a crack defect exists or not by the ultrasound crack detection; and e: purifying: removing fragments and residues on metal surfaces of a component to be repaired with NaOH, $Na_2CO_3$ and $NaNO_3$;

2) providing primary anneal: sampling for detecting a chemical element ingredient of a base, and identifying proportions of different chemical elements in the base; calculating a coefficient of expansion, and setting overall temperature increase and decrease time and speed of the universal coupling, putting into an ion radiation furnace, and providing gradient heating;

3) forming gradient in an order of a bonding layer, a transition layer, a working layer and a processing layer, preparing depositing alloys with an immerse-melting method; depositing layer by layer with a high-power welding machine and a special welding stick, in such a manner that 43% of the depositing alloys infiltrate into 57% of a base metal according to a depositing layer requirement until a certain redundancy is reached;

4) providing secondary anneal: after a depositing layer reaches the certain redundancy, putting into the ion radiation furnace again; according to a design requirement, controlling a temperature during a whole process, keeping the temperature and then providing gradient cooling as well as eliminating a welding stress, for avoiding too much contrast of an overall temperature of the base which forms a new stress construction point and thus generates new potential break; after reaching a design temperature, taking out of the ion radiation furnace and cooling to a room temperature;

5) firstly milling a peak of the depositing layer with a manual milling method, then machining and mechanically milling a repaired portion, so as to ensure that a repaired surface satisfies size and performance requirements of a blueprint; and 6) controlling a quality: through appearance analysis and comparison, size detection, hardness comparison before and after repairing, chemical element detection of a depositing area and the base, the ultrasound crack detection, and magnetic powder crack detection, ensuring the quality of overall repairing.

2. The method, as recited in claim 1, wherein temperatures of the gradient heating of the primary anneal are 30° C., 50° C., 100° C., 150° C., 200° C., 250° C., 300° C., 350° C., 400° C., and 480° C. in sequence, a period for each temperature is 0.5-1.5 h.

3. The method, as recited in claim 1, wherein temperatures of the gradient cooling of the secondary anneal are 280° C., 250° C., 200° C., 150° C., 100° C., 50° C. and 30° C. in sequence, a period for each temperature is 0.5-1.5 h.

4. The method, as recited in claim 1, wherein at the bonding layer, S and P in the depositing area are diluted with an FGM-KM1# material, for removing or reducing the S and P, so as to avoid cold and hot cracks; the FGM-KM1# material comprises Ni 0.70-0.80%, C 0.066-0.070%, Mn 0.4-0.42%, WC 0.14-0.16%, and S 0.010-0.22%.

5. The method, as recited in claim 1, wherein the transition layer is a coating layer with a gradient feature according to a depth requirement of a work piece break point, whose depositing depth is above 1-1000 mm, for transiting, gradually hardening and size recovering; the transition layer is formed by an FGM-KM2# material for improving impact toughness and evacuation stress, and appropriate increasing hardness; the FGM-KM2# material comprises C≤10%, Mn 1.30-1.40%, Si≤0.48%, Mo 0.28-0.40%, Ni 1.50%, Cr≤0.60%, S≤0.020%, and P≤0.018%.

6. The method, as recited in claim 1, wherein the processing layer is a ferrite soft layer, which is conducive to machining and improving manufacturing speed; the processing layer is entered easily and rapidly; and after fine processing, a technical requirement of a hard-surface alloy layer is satisfied;

wherein the processing layer is formed by an FGM-KM4# material, comprising C 0.07%, Fe 0.32%, Mn 0.30%, Si 0.16%, S 0.01%, and P 0.010%.

* * * * *